US008456227B2

(12) United States Patent
Hirashiki et al.

(10) Patent No.: US 8,456,227 B2
(45) Date of Patent: Jun. 4, 2013

(54) CURRENT MIRROR CIRCUIT

(75) Inventors: Kenichi Hirashiki, Kanagawa-ken (JP); Norio Hagiwara, Tokyo (JP); Tsutomu Nakashima, Kanagawa-ken (JP); Minoru Nagata, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 161 days.

(21) Appl. No.: 13/046,953

(22) Filed: Mar. 14, 2011

(65) Prior Publication Data

US 2011/0304387 A1 Dec. 15, 2011

(30) Foreign Application Priority Data

Jun. 14, 2010 (JP) ..... P2010-134949

(51) Int. Cl.
*G05F 1/10* (2006.01)

(52) U.S. Cl.
USPC ..... 327/543

(58) Field of Classification Search
USPC ..... 323/315; 327/535, 537, 538, 543
See application file for complete search history.

(56) References Cited

U.S. PATENT DOCUMENTS

| | | | | |
|---|---|---|---|---|
| 4,893,090 | A * | 1/1990 | Boudewijns | 330/253 |
| 5,359,296 | A * | 10/1994 | Brooks et al. | 330/288 |
| 5,525,927 | A * | 6/1996 | Yung et al. | 327/543 |
| 5,781,061 | A | 7/1998 | Miyashita et al. | |
| 5,801,523 | A * | 9/1998 | Bynum | 323/315 |
| 5,835,994 | A * | 11/1998 | Adams | 323/315 |
| 6,798,279 | B2 * | 9/2004 | Ebner | 327/543 |

FOREIGN PATENT DOCUMENTS

| | | |
|---|---|---|
| JP | 09-232881 | 9/1997 |
| WO | 2006043130 A1 | 4/2006 |

OTHER PUBLICATIONS

Charalampidis et al., "Analysis, simulation and circuit implementation of a precise high-output impedance analog current mirror", IEEE, Mediterranean Electrotechnical Conference, MELECON, 2010, pp. 749-754.

Prodanov, et al., "CMOS current mirrors with reduced input and output voltage requirements", IEEE, Electronics Letters, vol. 32, Issue 2, 1996, pp. 104-105.

Kaya, et al., "A Modified Active Current Mirror Suitable for Current-Mode Algorithmc Analog-To-Digital Converters", IEEE Electronics, Circuits and Systems, 2002, 9th International Conference, vol. 1, pp. 257-260.

* cited by examiner

*Primary Examiner* — Jeffrey Zweizig
(74) *Attorney, Agent, or Firm* — Turocy & Watson, LLP

(57) ABSTRACT

In one embodiment, a current mirror circuit includes first to fourth insulated gate field effect transistors (FETs), and a bias circuit. The gate electrodes of the first and second FETs are connected to each other. The source electrode of the third FET is connected to the drain electrode of the first FET, and the drain electrode of the third FET is connected to the gate electrodes of the first and second FETs and a current input terminal. The gate electrode of the fourth FET is connected to the gate electrode of the third FET, the source electrode of the fourth FET is connected to the drain electrode of the second FET, and the drain electrode of the fourth FET becomes a current output terminal. The bias circuit is configured to provide a bias voltage to the gate electrodes of the third and fourth FETs.

21 Claims, 6 Drawing Sheets

CURRENT MIRROR CIRCUIT

CROSS REFERENCE TO RELATED APPLICATION

This application is based upon and claims the benefit of priority from the prior Japanese Patent Application No. 2010-134949, filed on Jun. 14, 2010, the entire contents of which are incorporated herein by reference.

FIELD

Embodiments described herein relate generally to a current mirror circuit.

BACKGROUND

A conventional current mirror circuit includes a first FET (Field Effect Transistor) into which a current is inputted, a second FET which outputs the current and a third FET which is connected to the second FET in series. The drain electrode of the first FET and the gate electrode of the first FET are short-circuited. The gate electrode of the second FET is connected to the gate electrode of the first FET. A bias voltage which is the same as the bias voltages of the first and second FETs is provided to the gate electrode of the third FET.

The conventional current mirror circuit has a problem in that the gate voltage of the second FET changes due to a parasitic capacitance between the drain electrode of the third FET and the gate electrode of the third FET when the output voltage is changed, therefore the output current changes in accordance with the change of the gate voltage of the second FET.

In order to solve the problem, it is necessary that an electric charge stored in a parasitic capacitance between the drain electrode of the third FET and the gate electrode of the third FET by the change of the output voltage is discharged outside.

The conventional current mirror circuit has also a problem in that the output current shifts from a designed value, and accuracy falls because of the difference between the operating voltage of the first FET and the operating voltage of the second FET, In contrast, a current mirror circuit which suppresses an error of the output current depending on the output voltage has been known. Such kind of current mirror circuit is disclosed in Japanese Patent Application Publication No. 9-232881.

The current mirror circuit includes first, second, third, and fourth FETs. The gate electrodes of the first and second FETs are connected to each other. The source electrode of the third FET is connected to the drain electrode of the first FET, the drain electrode of the third FET and the gate electrode of the third FET are connected to each other, and to a current input terminal. The source electrode of the fourth FET is connected to the drain electrode of the second FET, the gate electrode of the fourth FET is connected to the gate electrode of the third FET, and the drain electrode of the fourth FET becomes a current output terminal.

Furthermore, the source electrodes of the first and second FETs are connected to each other, and to a negative side power supply terminal. The current mirror circuit also includes a resistor, a level shift circuit, a fifth FET and a current source. One end of the resistor is connected to the source electrode of the first FET, and another end of the resistor is connected to the gate electrode of the first FET. The low potential side of the level shift circuit is connected to the gate electrode of the first FET. The source electrode of the fifth FET is connected to the high potential side of the level shift circuit, the gate electrode of the fifth FET is connected to the gate electrode of the third FET, and the drain electrode of the fifth FET is connected to a positive side power supply terminal. The current source is connected between the positive side power supply terminal and the current input terminal.

However, the current mirror circuit is suppressing the deviation of the output current to the steady shift of the output voltage, and provides neither any disclosure nor suggestion about the transient change of the output voltage. Since the current mirror circuit has the resistor, power consumption increases, and there is a problem of causing increase of circuit area.

DETAILED DESCRIPTION

Figure 1:
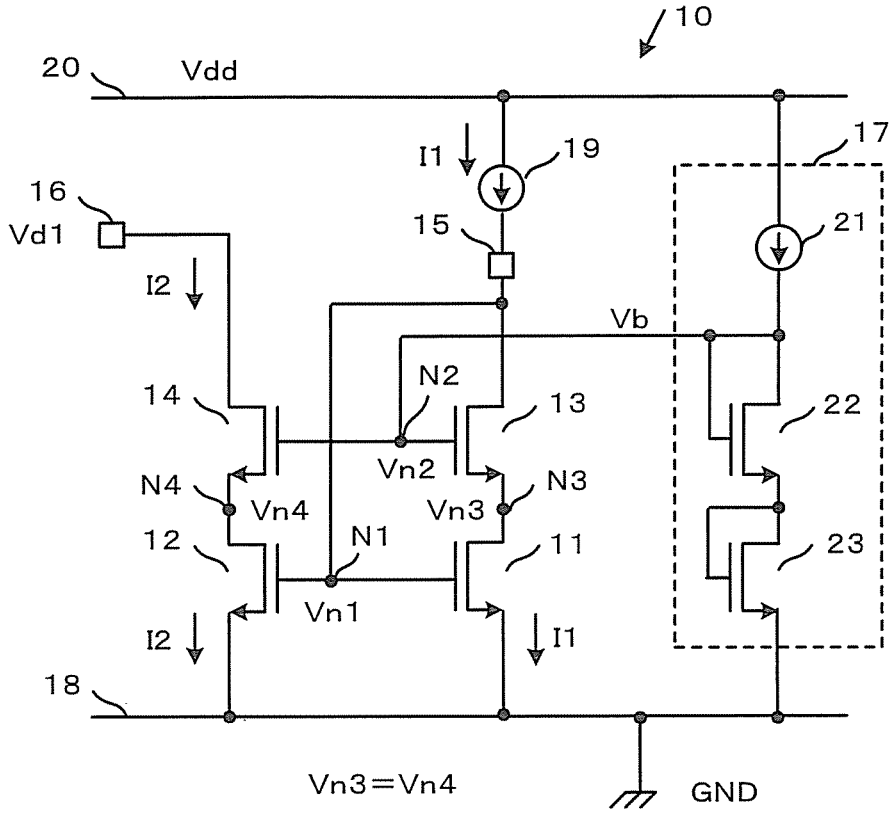
FIG. 1 is a circuit diagram showing a current mirror circuit according to an embodiment.

In one embodiment, a current mirror circuit includes first to fourth insulated gate field effect transistors having a drain electrode, a source electrode and a gate electrode, and a bias circuit. The first and second insulated gate field effect transistors are an enhancement mode MOS transistor respectively. The third and fourth insulated pate field effect transistors are a depletion mode MOS transistor respectively. The gate electrodes of the first and second insulated gate field effect transistors are connected to each other. The source electrode of the third insulated gate field effect transistor is connected to the drain electrode of the first insulated gate field effect transistor, and the drain electrode of the third insulated gate field effect transistor is connected to the gate electrodes of the first and second insulated gate field effect transistors and a current input terminal. The gate electrode of the fourth insulated gate field effect transistor is connected to the gate electrode of the third insulated gate field effect transistor, the source electrode of the fourth insulated gate field effect transistor is connected to the drain electrode of the second insulated gate field effect transistor, and the drain electrode of the fourth insulated gate field effect transistor becomes a current output terminal. A bias circuit is configured to provide a bias voltage to the gate electrodes of the third and fourth insulated gate field effect transistors.

Hereinafter, the embodiment will be described with reference to the drawings. In the drawings, same reference characters denote the same or similar portions.

Embodiment

Figure 2:
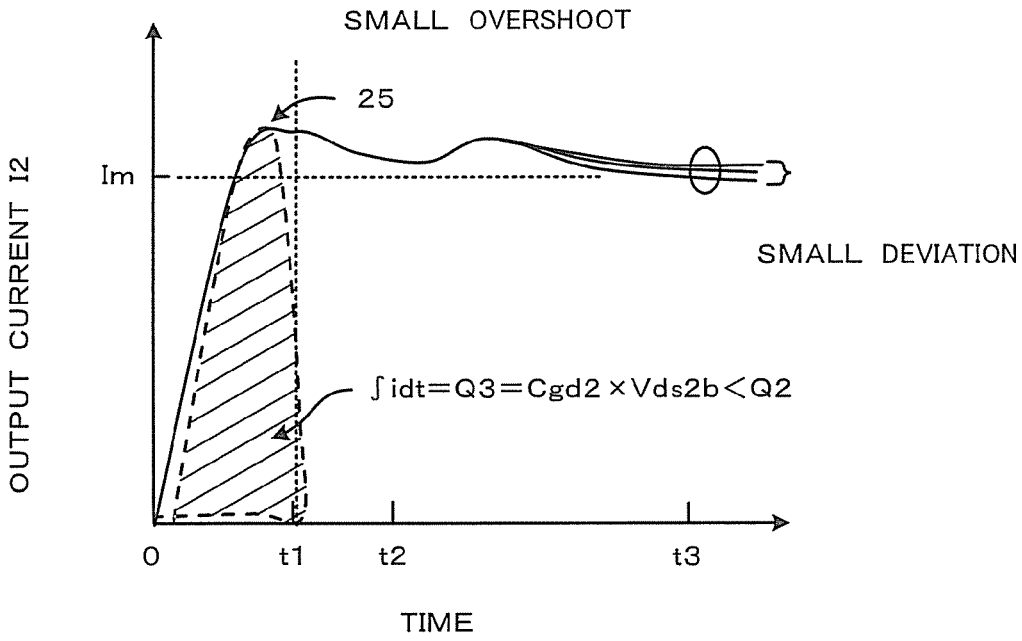
FIG. 2 is a graph showing the output current characteristic of the current mirror circuit according to the embodiment.

An embodiment will be described with reference to FIGS. 1 and 2. FIG. 1 is a circuit diagram showing a current mirror circuit. FIG. 2 is a graph showing the output current characteristic of the current mirror circuit.

As shown in FIG. 1, in a current mirror circuit 10 of the embodiment, a gate electrode of a first N-channel insulated gate field effect transistor 11 (hereinafter, simply named the first MOS transistor 11) and a gate electrode of a second N-channel insulated gate field effect transistor 12 (hereinafter, simply named the second MOS transistor 12) are connected to a node N1 respectively.

A gate electrode of a third N-channel insulated gate field effect transistor 13 (hereinafter, simply named the third MOS transistor 13) and a gate electrode of a fourth N-channel insulated gate field effect transistor 14 (hereinafter, simply named the fourth MOS transistor 14) are connected to a node N2 respectively.

The drain electrode of the first MOS transistor 11 and the source electrode of the third MOS transistor 13 are connected to a node N3. The first MOS transistor 11 and the third MOS transistor 13 are connected in cascode.

In one embodiment, a current mirror circuit includes first to fourth insulated gate field effect transistors having a drain electrode, a source electrode and a gate electrode, and a bias circuit. The first and second insulated gate field effect transistors are an enhancement mode MOS transistor respectively. The third and fourth insulated gate field effect transistors are a depletion mode MOS transistor respectively. The gate electrodes of the first and second insulated gate field effect transistors are connected to each other. The source electrode of the third insulated gate field effect transistor is connected to the drain electrode of the first insulated gate field effect transistor, and the drain electrode of the third insulated gate field effect transistor is connected to the gate electrodes of the first and second insulated gate field effect transistors and a current input terminal. The gate electrode of the fourth insulated gate field effect transistor is connected to the gate electrode of the third insulated gate field effect transistor, the source electrode of the fourth insulated gate field effect transistor is connected to the drain electrode of the second insulated gate field effect transistor, and the drain electrode of the fourth insulated gate field effect transistor becomes a current output terminal. A bias circuit is configured to provide a bias voltage to the gate electrodes of the third and fourth insulated gate field effect transistors.

The drain electrode of the third MOS transistor 13 is connected to a current input terminal 15. The drain electrode of the fourth MOS transistor 14 becomes a current output terminal 16.

The drain electrode of the third MOS transistor 13 is connected to the node N1. A bias voltage which is substantially equal to the summation of the operating voltage Vds1 of the first MOS transistor 11 and the operating voltage Vds3 of the third MOS transistor 13 is provided to the gate electrodes of the first and second MOS transistors 11, 12.

The operating voltage Vds1 has a relation of Vds1=Vth1+Von1. The operating voltage Vds3 has a relation of Vds3=Vth3+Von3. Therefore, the potential Vn1 of the node N1 has a relation of Vn1=Vds1+Vds3.

Where Vth1 is the threshold voltage of the first MOS transistor 11, Vth3 is the threshold voltage of the third MOS transistor 13, Von1 is the saturation voltage of the first MOS transistor 11, and Von3 is the saturation voltage of the third MOS transistor 13.

A bias circuit 17 is connected to the node N2. A predetermined bias voltage from the bias circuit 17 is provided to the gate electrodes of the third and fourth MOS transistors 13, 14. Therefore, the potential Vn2 of the node N2 has a relation of Vn2=Vth3+Von1+Von3.

The source electrodes of the first and second MOS transistors 11, 12 are connected to a low potential wiring 18. The low potential wiring 18 is connected to a reference potential GND.

The current input terminal 15 is connected to a high potential wiring 20 through a constant current source 19. The high potential wiring 20 is connected to a power supply (not shown) of Vdd in the voltage.

The constant current source 19 can be composed of a P-channel MOS transistor, for example, of which the source electrode is connected to the high potential wiring 20, the drain electrode is connected to the current input terminal 15. A predetermined bias voltage is provided to the gate electrode of the P-channel MOS transistor.

The bias circuit 17 is connected between the low potential wiring 18 and the high potential wiring 20, and includes a series circuit of a constant current source 21 and diodes. The diodes consist of N-channel MOS transistors 22, 23 of which the gate electrode and the drain electrode are connected. The constant current source 21 is the same as the constant current source 19. Therefore, the explanation of the constant current source 21 is omitted.

The first and second MOS transistors 11, 12 are an enhancement mode MOS transistor respectively. The threshold voltages of the first and second MOS transistors 11, 12 are substantially equal. The ratio of W1/L1 and W2/L2 (first mirror ratio) is set to m, for example, 10, where W1/L1 is the ratio of the gate width of the first MOS transistor 11 and the gate length of the first MOS transistor 11, and W2/L2 is the ratio of the gate width of the second MOS transistor 12 and the gate length of the second MOS transistor 12.

The third and fourth MOS transistors 13, 14 are a depletion mode MOS transistor respectively. The threshold voltages of the third and fourth MOS transistors 13, 14 are substantially equal. The ratio of W3/L3 and W4/L4 (second mirror ratio) is set to 10 which is substantially equal the ratio of W1/L1 and W2/L2, where W3/L3 is the ratio of the gate width of the third MOS transistor 13 and the gate length of the third MOS transistor 13, and W4/L4 is the ratio of the gate width of the fourth MOS transistor 14 and the gate length of the fourth MOS transistor 14.

The first and second MOS transistors 11, 12 can function as a basic current mirror circuit. The third and fourth MOS transistors 13, 14 are formed in order to make the basic current mirror circuit operate more accurately, and to make equal the drain voltages of the first and second MOS transistors 11, 12.

The fourth MOS transistor 14 is formed in order to intercept the drain voltage of the second MOS transistor 12 from the change of the output voltage Vd1 of the current output terminal 16.

Above described current mirror circuit 10 is configured to reduce the effect on the potential Vn1 of the node N1 from the transient change of the output voltage, and to maintain the potential Vn3 of the node N3 and the potential Vn4 of the node n4 equally at any time.

Figure 3:
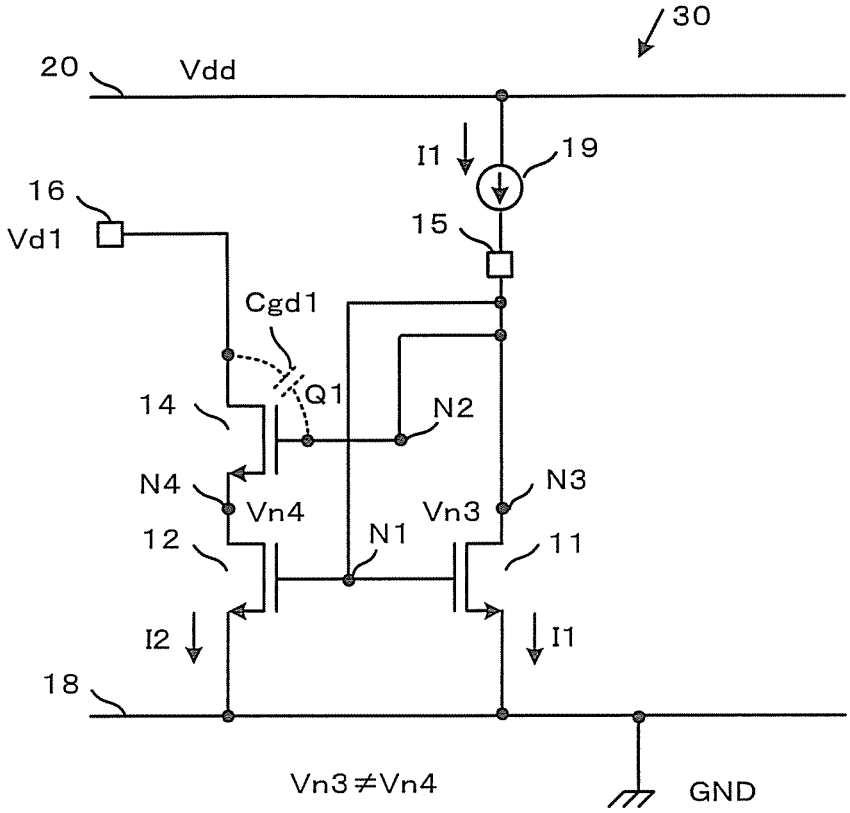
FIG. 3 is a circuit diagram showing a current mirror circuit of a first comparative example according to the embodiment.
Figure 4:
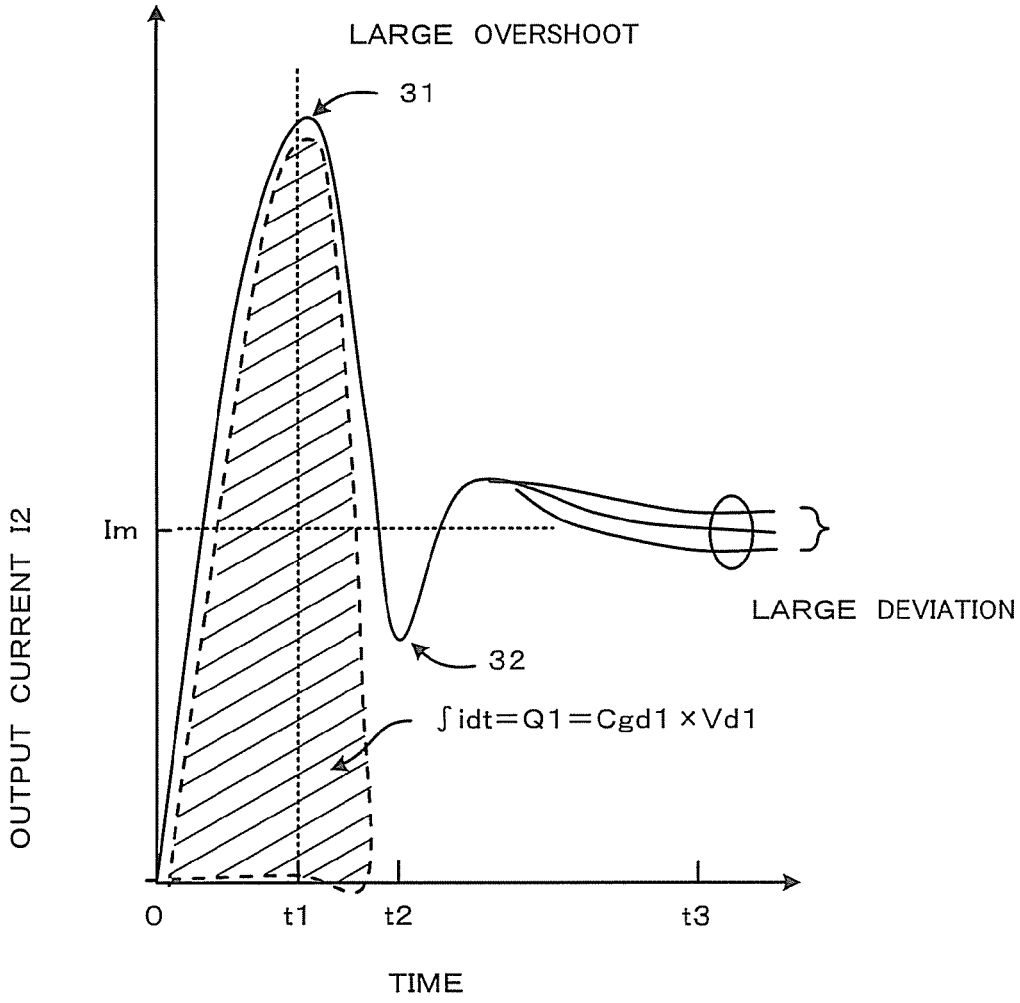
FIG. 4 is a graph showing the output current characteristic of the current mirror circuit of the first comparative example according to the embodiment.
Figure 5:
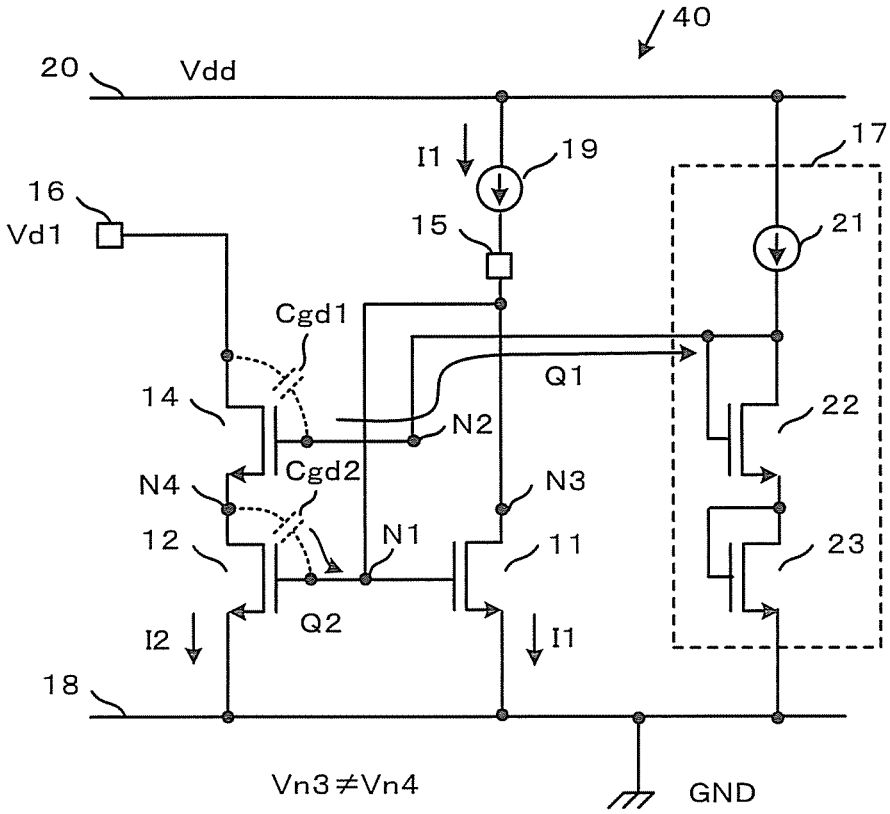
FIG. 5 is a circuit diagram showing a current mirror circuit of a second comparative example according to the embodiment.
Figure 6:
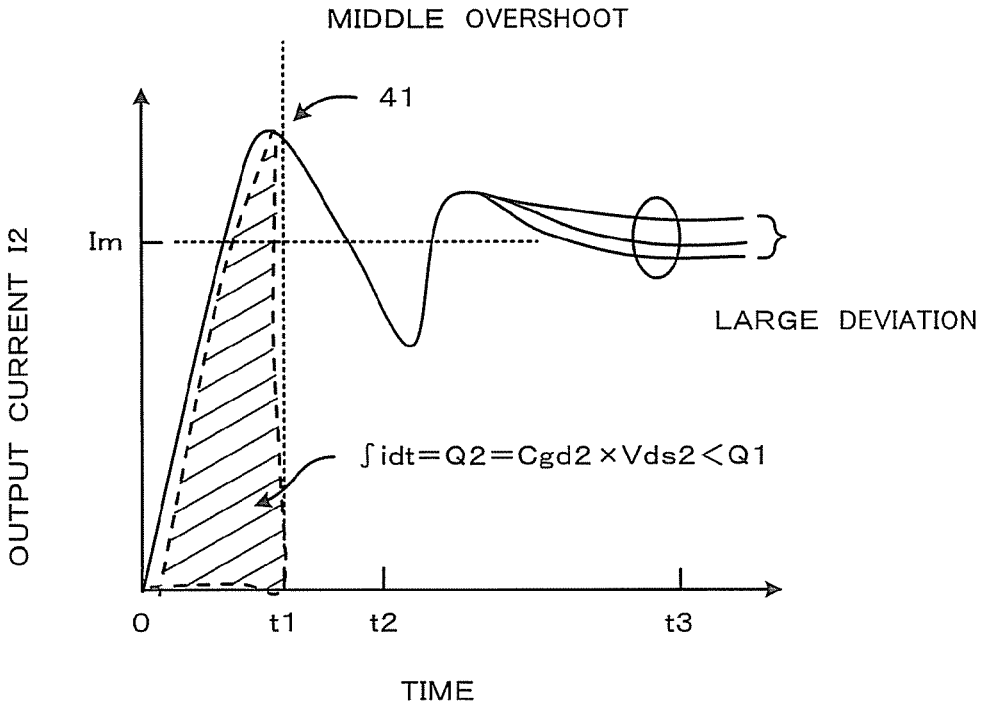
FIG. 6 is a graph showing the output current characteristic of the current mirror circuit of the second comparative example according to the embodiment.

The performance of the current mirror circuit 10 is explained in comparison with comparative examples. FIG. 3 is a circuit diagram showing a current mirror circuit of a first comparative example, FIG. 4 is a graph showing the output current characteristic of the current mirror circuit of the first comparative example. FIG. 5 is a circuit diagram showing a current mirror circuit of a second comparative example, FIG. 6 is a graph showing the output current characteristic of the current mirror circuit of the second comparative example.

Where, the first comparative example is a current mirror circuit which does not include the third MOS transistor 13 and the bias circuit 17, the second comparative example is a current mirror circuit which does not include only the third MOS transistor 13. Firstly, the first and second comparative examples are explained.

As shown in FIG. 3, the first comparative example 30 is the current mirror circuit that the third MOS transistor 13 and the bias circuit 17 are excluded from the current mirror circuit 10. Then, the node N1, the node N2 and the current input terminal 15 are connected to the node N3.

As a result, the voltage substantially equal to the operating voltage Vds1 of the first MOS transistor 11 is provided to the gate electrodes of the first, second and fourth MOS transistors 11, 12, 14.

As an initial condition, an input current I1 flows from the constant current source 19 to the first MOS transistor 11, and the potential of the current output terminal 16 is substantially equal to the reference potential GND (Vd1=0V). The input current I1 that flows through the first MOS transistor 11 is expressed by the following equation:

$$I1=K1(W1/L1)(Vgs1-Vth1)^2/2 \quad (1)$$

where K1 is a constant determined by the mobility of the channel of the first MOS transistor 11 and the unit capacity of a gate insulating film of the first MOS transistor 11, W1/L1 is the ratio of the gate width of the first MOS transistor 11 and gate length of the first MOS transistor 11, and Vth1 is the threshold voltage of the first MOS transistor 11. Then, the operating voltage Vds1 of the first MOS transistor 11 has a relation of Vds1=Vgs1.

At this time, an output current I2 that flows through the second MOS transistor 12 becomes 0. An initial electric charge (Cgd1×Vgs1) is stored in a parasitic capacitance Cgd1 between the drain electrode of the fourth MOS transistor 14 and the gate electrode of the fourth MOS transistor 14.

As shown in FIG. 4, the output voltage Vd1 is provided to the current output terminal 16 at a time point t=0, an electric charge Q1 (Cgd1×Vd1) is stored in the parasitic capacitance Cgd1. The gate voltage of the second MOS transistor 12 transiently increases from the gate electrode of the fourth MOS transistor 14 through the nodes N1, N2.

As a result, until the electric charge Q1 is discharged, a current i transiently flows through the second MOS transistor 12, and a large overshoot 31 is caused in the output current I2. The current i is expressed by the following equation:

$$\int idt=Q1=Cgd1\times Vds1 \quad (2)$$

after the electric charge Q1 is discharged, the output current I2 becomes from the transient state to the steady state (a time point t3) causing the undershoot 32 (a time point t2) as the reaction.

However, there is a difference between the potential Vn3 of the node N3 and the potential Vn4 of the node N4 so that the first, second and third potentials Vn1, Vn2, Vn3 of the nodes N1, N2, N3 substantially become equal with each other. As a result, the output current I2 deviates from the designed value Im, and a large deviation is caused.

As shown in FIG. 5, the current mirror circuit 40 of the second comparative example is the current mirror circuit that only the third MOS transistor 13 is excluded from the current mirror circuit 10. Then, the node N1 and the current input terminal 15 are connected to the node N3.

As a result, the voltage equal to the operating voltage Vds1 of the first MOS transistor 11 is provided to the gate electrodes of the first and second MOS transistors 11, 12.

As shown in FIG. 6, the current mirror circuit 40 is similar to the current mirror circuit 30 in that the output voltage Vd1 is provided to the current output terminal 16 at a time point t=0, then the electric charge Q1 is stored in the parasitic capacitance Cgd1. However, the electric charge Q1 is bypassed to the bias circuit 17 side because the gate electrode of the fourth MOS transistor 14 is connected to the bias circuit 17. As a result, the overshoot 31 by the electric charge Q1 is not caused because the gate voltage of the second MOS transistor 12 is not affected by the electric charge Q1.

However, the gate voltage of the second MOS transistor 12 transiently increases by an electric charge Q2 stored in a parasitic capacitance Cgd2 between the drain electrode of the second MOS transistor 12 and the gate electrode of the second MOS transistor 12.

As a result, until the electric charge Q2 is discharged, a current i transiently flows through the second MOS transistor 12, and an overshoot 41 is caused in an output current I2. The current i is expressed by the following equation:

$$\int idt=Q2=Cgd2\times Vds2<Q1 \quad (3)$$

where the Vds2 is the operating voltage of the second MOS transistor 12.

The parasitic capacitance Cgd1 is the same as the parasitic capacitance Cgd2. The electric charge Q2 becomes smaller than the electric charge Q1 because the operating voltage Vds2 of the second MOS transistor 12 is lower than the operating voltage Vds1 of the first MOS transistor 11. As a result, the overshoot 41 becomes smaller than the overshoot 31. The output current I2 at the steady state (a time point t3) stays equal to the output current I2 of the current mirror circuit 30.

In the current mirror circuits 30, 40 of the first and second comparative examples, when the output voltage Vd1 is changed, the overshoots 31, 41 are transiently caused in the output currents I2 due to the parasitic capacitance between the drain electrode and the gate electrode. Furthermore, the steady-state deviations from the designed value Im are caused in the output currents I2 due to the unbalance of the potential Vn3 of the node N3 and the potential Vn4 of the node N4.

On the other hand, the current mirror circuit 10 of the embodiment is similar to the current mirror circuit 40 in that the gate voltage of the second MOS transistor 12 is not affected by the electric charge Q1 because the electric charge Q1 is bypassed to the bias circuit 17 side.

Furthermore, the operating voltage Vds2 of the second MOS transistor 12 can be reduced in accordance with the operating voltage Vds3 of the third MOS transistor 13. As a result, the gate voltage of the second MOS transistor 12 transiently increases by the electric charge Q3 stored in the parasitic capacitance Cgd2 between the drain electrode of the second MOS transistor 12 and the gate electrode of the second MOS transistor 12.

As a result, until the electric charge Q3 is discharged, a current i flows transiently through the second MOS transistor 12, and an overshoot 25 is caused in an output current I2. The current i is expressed by the following equation:

$$\int idt=Q3=Cgd2\times Vds2b<Q2 \quad (4)$$

where the Vds2*b* is the operating voltage of the second MOS transistor 12. The electric charge Q3 becomes smaller than the electric charge Q2 because Vds2*b* is lower than Vds2, and the overshoot 25 can become smaller than the overshoot 41.

The operating voltages of the third and fourth MOS transistor 13, 14, in other word, the potential Vn3 of the node N3 and the potential Vn4 of the node N4 are forced to become the same. Accordingly, the deviation of the output current I2 of the second MOS transistor 12 from the designed value Im can become smaller.

As described above, in the current mirror circuit 10 of the embodiment, the gate electrodes of the first and second MOS transistors 11, 12 are connected to each other. The third and fourth MOS transistors 13, 14 of which gate electrodes are connected to each other are connected to the first and second MOS transistors 11, 12 in cascode respectively.

The bias voltage which is substantially equal to the summation of the operating voltage Vds1 of the first MOS transistors 11 and the operating voltage Vds3 of the third MOS transistors 13 is provided to the gate electrodes of the first and second MOS transistors 11, 12. The predetermined bias voltage from the bias circuit 17 is provided to the gate electrodes of the third and fourth MOS transistor 13, 14.

As a result, the current mirror circuit 10 can operate so that the change of the output voltage Vd1 does not affect on the potential Vn1 of the node N1, and the potential Vn3 of the node N3 substantially become equal to the potential Vn4 of the node N4. Thus, the current mirror circuit 10 with small change of the output current I2 can be obtained.

In the embodiment, the description is given of the case where the first to fourth MOS transistors 11, 12, 13, 14 are the N-channel MOS transistor respectively. However, the current mirror circuit 10 can operate in the case where the first to fourth MOS transistors 11, 12, 13, 14 are a P-channel MOS transistor respectively.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A current mirror circuit, comprising:

first and second insulated gate field effect transistors having a drain electrode, a source electrode and a gate electrode, the gate electrodes of the first and second insulated gate field effect transistors being connected to each other; wherein the first and second insulated gate field effect transistors are an enhancement mode insulated gate field effect transistor respectively, a third insulated gate field effect transistor having a drain electrode, a source electrode and a gate electrode, the source electrode of the third insulated gate field effect transistor being connected to the drain electrode of the first insulated gate field effect transistor, and the drain electrode of the third insulated gate field effect transistor being connected to the gate electrodes of the first and second insulated gate field effect transistors and a current input terminal;

a fourth insulated gate field effect transistor having a drain electrode, a source electrode and a gate electrode, the gate electrode of the fourth insulated gate field effect transistor being connected to the gate electrode of the third insulated gate field effect transistor, the source electrode of the fourth insulated gate field effect transistor being connected to the drain electrode of the second insulated gate field effect transistor, and the drain electrode of the fourth insulated gate field effect transistor becoming a current output terminal, wherein the third and fourth insulated gate field effect transistors are a depletion mode insulated gate field effect transistor respectively; and a bias circuit configured to provide a bias voltage to the gate electrodes of the third and fourth insulated gate field effect transistors.

2. The current mirror circuit according to claim 1, wherein the source electrodes of the first and second insulated gate field effect transistors are connected to a low potential wiring respectively, the current input terminal is connected to a high potential wiring through a constant current source.

3. The current mirror circuit according to claim 2, wherein the bias circuit is connected between the low potential wiring and the high potential wiring, and includes a series circuit of a constant current source and a diode.

4. The current mirror circuit according to claim 1, wherein an electric charge stored in a parasitic capacitance between the drain electrode of the fourth insulated gate field effect transistor and the gate electrode of the fourth insulated gate field effect transistor is discharged outside via the bias circuit when a voltage provided to the drain electrode of the fourth insulated gate field effect transistor is changed.

5. The current mirror circuit according to claim 1, wherein the threshold voltage of the first insulated gate field effect transistor is substantially equal to the threshold voltage of the second insulated gate field effect transistor.

6. The current mirror circuit according to claim 1, wherein the threshold voltage of the third insulated gate field effect transistor is substantially equal to the threshold voltage of the fourth insulated gate field effect transistor.

7. The current mirror circuit according to claim 1, wherein a first mirror ratio determined by a ratio of W1/L1 and W2/L2 is substantially equal to a second mirror ratio determined by a ratio of W3/L3 and W4/L4, where W1/L1 is the ratio of the gate width of the first insulated gate field effect transistor and the gate length of the first insulated gate field effect transistor, W2/L2 is the ratio of the gate width of the second insulated gate field effect transistor and the gate length of the second insulated gate field effect transistor, W3/L3 is the ratio of the gate width of the third insulated gate field effect transistor and the gate length of the third insulated gate field effect transistor, W4/L4 is the ratio of the gate width of the fourth insulated gate field effect transistor and the gate length of the fourth insulated gate field effect transistor.

8. The current mirror circuit according to claim 1, wherein the operating voltage between the drain electrode of the first insulated gate field effect transistor and the source electrode of the first insulated gate field effect transistor is substantially equal to the operating voltage between the drain electrode of the second insulated gate field effect transistor and the source electrode of the second insulated gate field effect transistor.

9. A current mirror circuit, comprising:

first and second insulated gate field effect transistors having a drain electrode, a source electrode and a gate electrode, the gate electrodes of the first and second insulated gate field effect transistors being connected to each other, the source electrodes of the first and second insulated gate field effect transistors being connected to a low potential wiring respectively;

a third insulated gate field effect transistor having a drain electrode, a source electrode and a gate electrode, the source electrode of the third insulated gate field effect transistor being connected to the drain electrode of the first insulated gate field effect transistor, and the drain electrode of the third insulated gate field effect transistor being connected to the gate electrodes of the first and second insulated gate field effect transistors and a current input terminal, the current input terminal being connected to a high potential wiring through a constant current source;

a fourth insulated gate field effect transistor having a drain electrode, a source electrode and a gate electrode, the gate electrode of the fourth insulated gate field effect transistor being connected to the gate electrode of the third insulated gate field effect transistor, the source electrode of the fourth insulated gate field effect transistor being connected to the drain electrode of the second insulated gate field effect transistor, and the drain electrode of the fourth insulated gate field effect transistor becoming a current output terminal; and a bias circuit configured to provide a bias voltage to the gate electrodes of the third and fourth insulated gate field effect transistors, the bias circuit being connected between the low potential wiring and the high potential wiring, and including a series circuit of a constant current source and a diode, wherein a first mirror ratio determined by a ratio of W1/L1 and W2/L2 is substantially equal to a second mirror ratio determined by a ratio of W3/L3 and W4/L4, where W1/L1 is the ratio of the gate width of the first insulated gate field effect transistor to the gate length of the first insulated gate field effect transistor, W2/L2 is the ratio of the gate width of the second insulated gate field effect transistor to the gate length of the second insulated gate field effect transistor, W3/L3 is the ratio of the gate width of the third insulated gate field effect transistor to the gate length of the third insulated gate field effect transistor, W4/L4 is the ratio of the gate width of the fourth insulated gate field effect transistor to the gate length of the fourth insulated gate field effect transistor.

10. The current mirror circuit according to claim 9, wherein the first and second insulated gate field effect transistors are an enhancement mode insulated gate field effect transistor respectively, the third and fourth insulated gate field effect transistors are a depletion mode insulated gate field effect transistor respectively.

11. The current mirror circuit according to claim 9, wherein an electric charge stored in a parasitic capacitance between the drain electrode of the fourth insulated gate field effect transistor and the gate electrode of the fourth insulated gate field effect transistor is discharged outside via the bias circuit when a voltage provided to the drain electrode of the fourth insulated gate field effect transistor is changed.

12. The current mirror circuit according to claim 9, wherein the threshold voltage of the first insulated gate field effect transistor is substantially equal to the threshold voltage of the second insulated gate field effect transistor.

13. The current mirror circuit according to claim 9, wherein the threshold voltage of the third insulated gate field effect transistor is substantially equal to the threshold voltage of the fourth insulated gate field effect transistor.

14. The current mirror circuit according to claim 9, wherein the operating voltage between the drain electrode of the first insulated gate field effect transistor and the source electrode of the first insulated gate field effect transistor is substantially equal to the operating voltage between the drain electrode of the second insulated gate field effect transistor and the source electrode of the second insulated gate field effect transistor.

15. A current mirror circuit, comprising:

first and second insulated gate field effect transistors having a drain electrode, a source electrode and a gate electrode, the gate electrodes of the first and second insulated gate field effect transistors being connected to each other;

a third insulated gate field effect transistor having a drain electrode, a source electrode and a gate electrode, the source electrode of the third insulated gate field effect transistor being connected to the drain electrode of the first insulated gate field effect transistor, and the drain electrode of the third insulated gate field effect transistor being connected to the gate electrode of the first and second insulated gate field effect transistors and a current input terminal;

a fourth insulated gate field effect transistor having a drain electrode, a source electrode and a gate electrode, the gate electrode of the fourth insulated gate field effect transistor being connected to the gate electrode of the third insulated gate field effect transistor, the source electrode of the fourth insulated gate field effect transistor being connected to the drain electrode of the second insulated gate field effect transistor, and the drain electrode of the fourth insulated gate field effect transistor becoming a current output terminal; and a bias circuit configured to provide a bias voltage to the gate electrodes of the third and fourth insulated gate field effect transistors, wherein a first mirror ratio determined by a ratio of W1/L1 and W2/L2 is substantially equal to a second mirror ratio determined by a ratio of W3/L3 and W4/L4, where W1/L1 is the ratio of the gate width of the first insulated gate field effect transistor to the gate length of the first insulated gate field effect transistor, W2/L2 is the ratio of the gate width of the second insulated gate field effect transistor to the gate length of the second insulated gate field effect transistor, W3/L3 is the ratio of the gate width of the third insulated gate field effect transistor to the gate length of the third insulated gate field effect transistor, W4/L4 is the ratio of the gate width of the fourth insulated gate field effect transistor to the gate length of the fourth insulated gate field effect transistor.

16. The current mirror circuit according to claim 15, wherein the source electrodes of the first and second insulated gate field effect transistors are connected to a low potential wiring respectively, the current input terminal is connected to a high potential wiring through a constant current source.

17. The current mirror circuit according to claim 16, wherein the bias circuit is connected between the low potential wiring and the high potential wiring, and comprises a series circuit of a constant current source and a diode.

18. The current mirror circuit according to claim 15, wherein an electric charge stored in a parasitic capacitance between the drain electrode of the fourth insulated gate field effect transistor and the gate electrode of the fourth insulated gate field effect transistor is discharged outside via the bias circuit when a voltage provided to the drain electrode of the fourth insulated gate field effect transistor is changed.

19. The current mirror circuit according to claim 15, wherein the threshold voltage of the first insulated gate field effect transistor is substantially equal to the threshold voltage of the second insulated gate field effect transistor.

20. The current mirror circuit according to claim 15, wherein the threshold voltage of the third insulated gate field effect transistor is substantially equal to the threshold voltage of the fourth insulated gate field effect transistor.

21. The current mirror circuit according to claim 15, wherein the operating voltage between the drain electrode of the first insulated gate field effect transistor and the source electrode of the first insulated gate field effect transistor is substantially equal to the operating voltage between the drain electrode of the second insulated gate field effect transistor and the source electrode of the second insulated gate field effect transistor.

* * * * *